US011198048B2

(12) United States Patent
Johnson

(10) Patent No.: US 11,198,048 B2
(45) Date of Patent: Dec. 14, 2021

(54) BALL RETURN ASSEMBLY

(71) Applicant: Fritz Johnson, Martinez, CA (US)

(72) Inventor: Fritz Johnson, Martinez, CA (US)

( * ) Notice: Subject to any disclaimer, the term of this patent is extended or adjusted under 35 U.S.C. 154(b) by 0 days.

(21) Appl. No.: 16/834,489

(22) Filed: Mar. 30, 2020

(65) Prior Publication Data

US 2020/0330845 A1 Oct. 22, 2020

Related U.S. Application Data

(60) Provisional application No. 62/830,494, filed on Apr. 7, 2019, provisional application No. 62/827,111, filed on Mar. 31, 2019.

(51) Int. Cl.
*A63B 69/00* (2006.01)
*A63B 63/00* (2006.01)

(52) U.S. Cl.
CPC ..... *A63B 69/0097* (2013.01); *A63B 63/00* (2013.01); *A63B 69/0079* (2013.01); *A63B 2063/001* (2013.01)

(58) Field of Classification Search
CPC . A63B 69/0097; A63B 63/00; A63B 69/0079; A63B 2063/001
USPC ..... 473/422–430, 446, 438
See application file for complete search history.

(56) References Cited

U.S. PATENT DOCUMENTS

| | | | | | |
|---|---|---|---|---|---|
| 702,910 | A * | 6/1902 | Austin et al. | A63B 69/408 | 473/423 |
| 3,105,682 | A * | 10/1963 | Ahrens | D06F 53/04 | 473/493 |
| 3,648,386 | A * | 3/1972 | Stone | A61H 5/00 | 434/430 |
| 3,953,029 | A * | 4/1976 | Boyd | A63B 69/0079 | 473/575 |
| 4,786,053 | A * | 11/1988 | Barnes, Jr. | A63B 71/023 | 473/416 |
| 5,072,937 | A * | 12/1991 | Zarate | A63B 69/0084 | 473/426 |
| 10,661,140 | B2 * | 5/2020 | Collier, III | A63B 69/3623 | 473/422 |
| 2016/0367878 | A1 * | 12/2016 | Bell | A63B 69/0079 | 473/422 |
| 2017/0056743 | A1 * | 3/2017 | Kroken | A63B 69/002 | 473/446 |
| 2020/0330845 | A1 * | 10/2020 | Johnson | A63B 63/00 | 473/147 |

* cited by examiner

*Primary Examiner* — Mitra Aryanpour

(57) ABSTRACT

A ball return assembly is configured to return a ball to a user. The ball return assembly has a base arranged on a ground surface with a first opening and a second opening. An elastic cord is threaded through the first opening and the second opening. A cord lock is joined to the cord first end, preventing the cord from being pulled from the base. A ball is joined to the cord. A frame is arranged proximate the base. The ball, upon contacting the frame, is pulled by the cord toward the base.

10 Claims, 9 Drawing Sheets

BALL RETURN ASSEMBLY

RELATED APPLICATION

This Application claims priority to provisional patent application U.S. Ser. No. 62/830,494 filed on Apr. 7, 2019.

This application claims priority to provisional patent application U.S. Ser. No. 62/827,111 filed on Mar. 31, 2019 (the "'111 application").

The entire contents of the '494 application and the '111 application are herein incorporated by reference.

BACKGROUND OF THE INVENTION

This invention relates to sports devices and in particular to sports devices wherein a ball is returned to a player. The device is in the form of a tethered ball return game. The preferred embodiment utilizes a tennis ball, but other sports balls could also be used. Thus, although tennis practice is the focus of the embodiment herein, it should be understood that other sports such as lacrosse, baseball, softball, racquetball, and cricket could utilize this invention.

Various tennis trainers have been manufactured that include a tennis ball on a cord tethered to a base, pole, or rail. A player applies force to the ball through hitting with a racket and then the ball returns to the player. Examples include devices shown in U.S. Pat. Nos. 4,093,225; 4,095,787; 4,138,107; 4,191,372; 5,681,168 and 7,749,110. The problem with these inventions is that the ball returns too quickly or chaotically to the player, and they do not simulate realistic playing conditions. Also, bases in these inventions require adding sand or water for weight, making these inventions less portable and surface limited.

Numerous tennis rebound nets without using any tethered ball have been known in the art. Examples include U.S. Pat. Nos. 2,992,002; 4,140,313; 4,456,251; 4,693,472; 4,743,020 and 6,357,750. With these inventions the player has difficulty achieving a repetitive, consistent ball return and therefore the player cannot develop muscle memory. Also these devices result in players having to chase every errant shot, as they do not utilize a ball tethered to a base.

The need exists for a tethered ball return system that simulates real play, wherein the player hits the ball over a regulation height tennis net and the ball returns to the player on one bounce within a timeframe and motion similar to real play. The need exists for a tethered ball return system that provides consistency and a high degree of player control such that the player can develop muscle memory through repetition. The need exists for the base of such a system to be portable and not limited by surface conditions. This invention includes a net apparatus that captures the ball and cord, and then releases the ball back to the player.

BRIEF SUMMARY OF THE INVENTION

This invention utilizes an elastic cord that is attached to a ball and is tethered to a base, and includes a net apparatus that receives the tethered ball and cord once the ball is hit or thrown. Unique to this invention is that the elastic cord is segmented with two or more segments that have different levels of elasticity. The elasticity increases along the length of the overall cord without doubling the cord, from the base to the ball. The preferred embodiment includes three cords of increasing elasticity connected end to end to form an overall cord that attaches the ball to the base. When the ball is hit over the net apparatus, the cord tension pulls the ball under the net apparatus while still maintaining tension. The cord wraps around the net apparatus and the ball strikes the side of the net facing the player. The ball then swings back under the net apparatus and back to the player. Once the ball bounces back to the player, the player then hits the ball again with his or her racket over the net apparatus and the process begins again. The increasing elasticity of the overall cord, along with the design of the net apparatus, provides for timing, bounce, and velocity of a ball return that simulates real play. The net apparatus includes an adjustable launch panel that varies the ball return trajectory and timing, and is designed in such a way as to simulate tennis court visuals with appropriate colors, netting, and height adjustment.

BRIEF DESCRIPTION OF THE DRAWINGS

The detailed description of some embodiments of the invention is made below with reference to the accompanying Figures, wherein like numerals represent corresponding parts of the Figures.

DETAILED DESCRIPTION OF THE INVENTION

Figure 1:
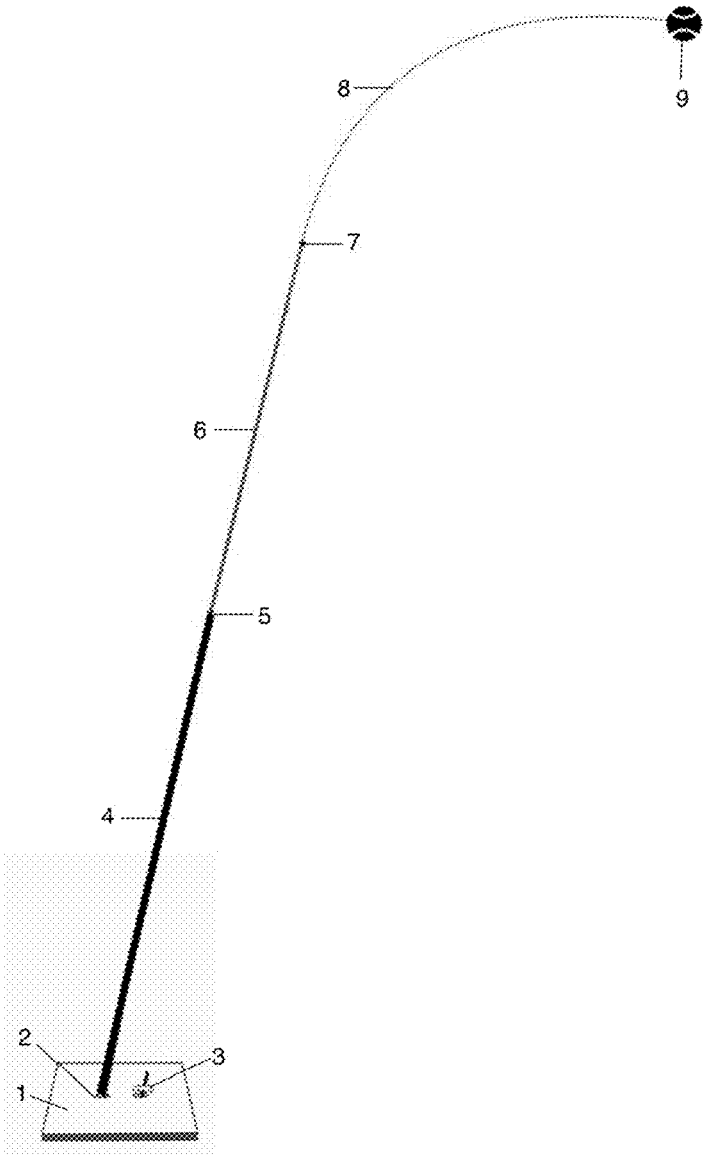
FIG. 1 shows an elevated front view of one embodiment of the present invention.

While the invention has been described in detail in the drawings and following description, It should be understood that only the preferred embodiment has been shown. The use of a tennis ball for tennis practice is described herein. Other sports balls like those used for lacrosse, baseball, softball, racquetball, or cricket, for example, could also be used with this invention. Changes or modifications that come within the spirit of this invention are desired to be protected.

Figure 2:
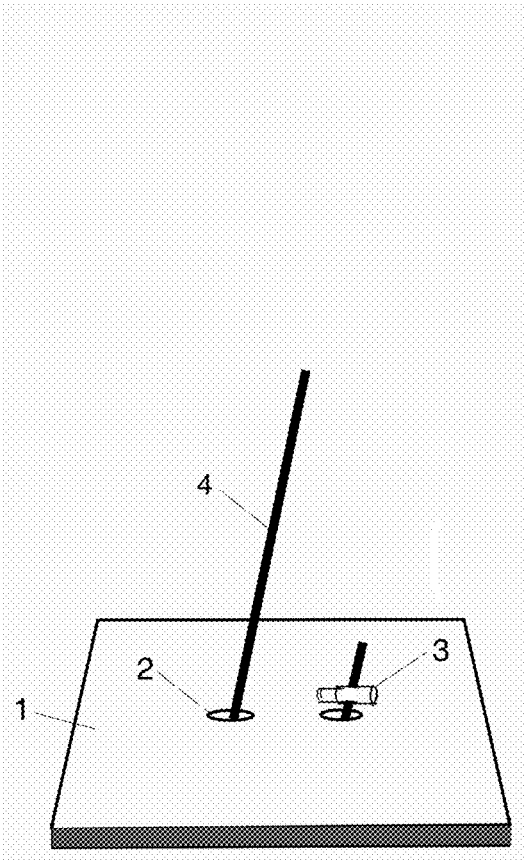
FIG. 2 shows a front detail view of one embodiment of the present invention.

FIG. 1 illustrates the ball 9 tethered to the base 1. The base 1 is of such size and material as to not move once the ball 9 is struck. The preferred embodiment utilizes recycled tires for the base 1 material. The base 1, as shown in FIG. 2, includes two holes with rubber flanges 2 inserted, allowing the cord 4 to pass under the base 1. A cord lock 3 keeps the cord 4 secured to the base 1 and also allows for adjusting the length of the overall cord. A groove on the bottom of the base 1 can also be utilized to direct the cord between the flanges 2. The groove and flanges 2 allow for the base 1 bottom to be flush with the ground maximizing the friction between the rubber base 1 and the playing surface.

Cord segments 4, 6, and 8 are connected together end to end and have different levels of elasticity. Cord 4 has a low level of elasticity, and is not easily stretched. Cord 6 has a moderate level of elasticity. Cord 8 has a high level of elasticity, and is easily stretched. For use with a tennis ball, the cords 4, 6, and 8 have the following characteristics: Cord 4, when 3 feet long and pulled by a force of 11.1 Newtons, elongates approximately 83% from its original length. Cord 6, when 3 feet long and pulled by a force of 11.1 Newtons, elongates approximately 134% from its original length. Cord 8, when 3 feet long and pulled by a force of 2.3 Newtons, elongates approximately 71% from its original length. The length of each cord 4, 6, and 8 can be varied based upon a player's hit power. More cord segments can be introduced and require increasing elasticity from the base 1 to the ball 9 for this invention to function properly. Cords 4, 6 and 8 are made of rubber with a weatherproof polyester protective sleeve.

The cords 4, 6, and 8 are connected at points 5 and 7. Connecting the cords 4, 6, and 8 together can be done with different mechanisms. In the preferred embodiment cord 4 is tied to cord 6 at point 5 using a double overhand knot, while cords 6 and 8 are tied at point 7 with a single overhand knot. Protective tape or tubing can be used at connecting points 5 and 7 to protect the cords 4. 6. and 8 from fraying, and add strength to the connection. Other cord connecting mechanisms can be used but need to be flexible as rigid connectors increase the possibility of cord failure.

The ball 9 is preferably non-pressurized which allows for the cord 8 to be connected to the ball 9 without altering the bounce of the ball 9. For tennis, non-pressurized practice balls and age stage youth tennis balls are preferred. Other sports balls of similar size and weight can also be used.

Figure 3:
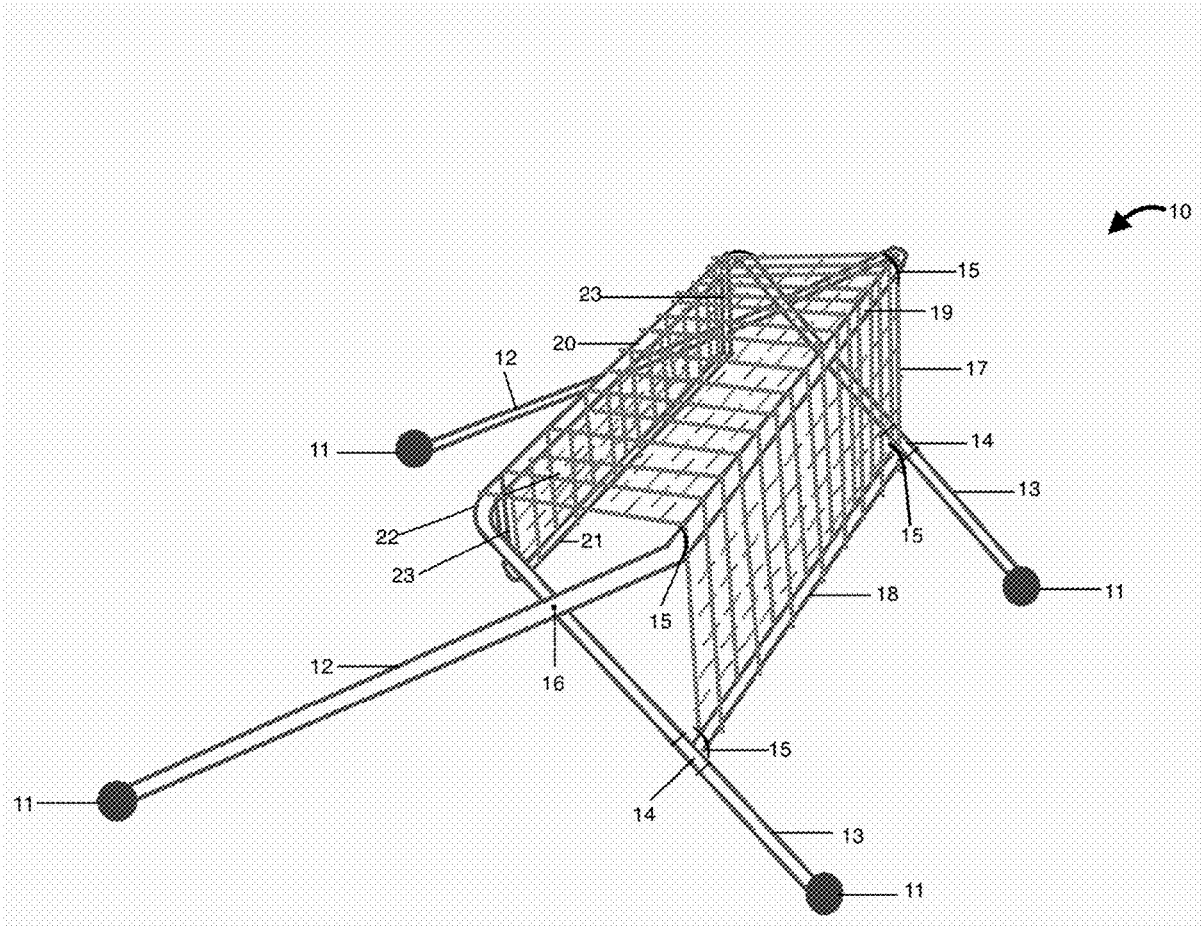
FIG. 3 shows an front perspective view of one embodiment of the present invention.
Figure 4:
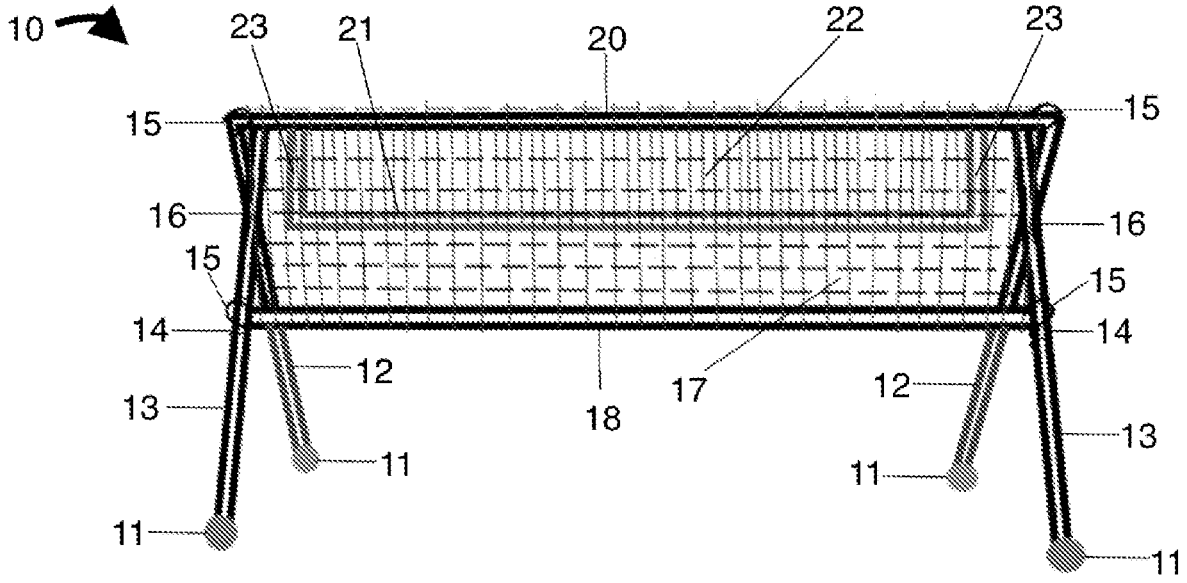
FIG. 4 shows a front perspective view of one embodiment of the present invention.
Figure 5:
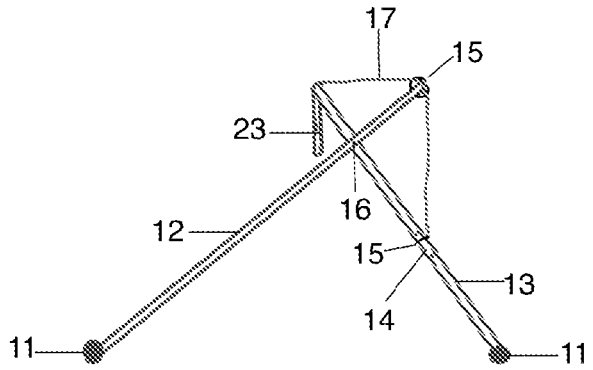
FIG. 5 shows a side perspective view of one embodiment of the present invention.
Figure 6:
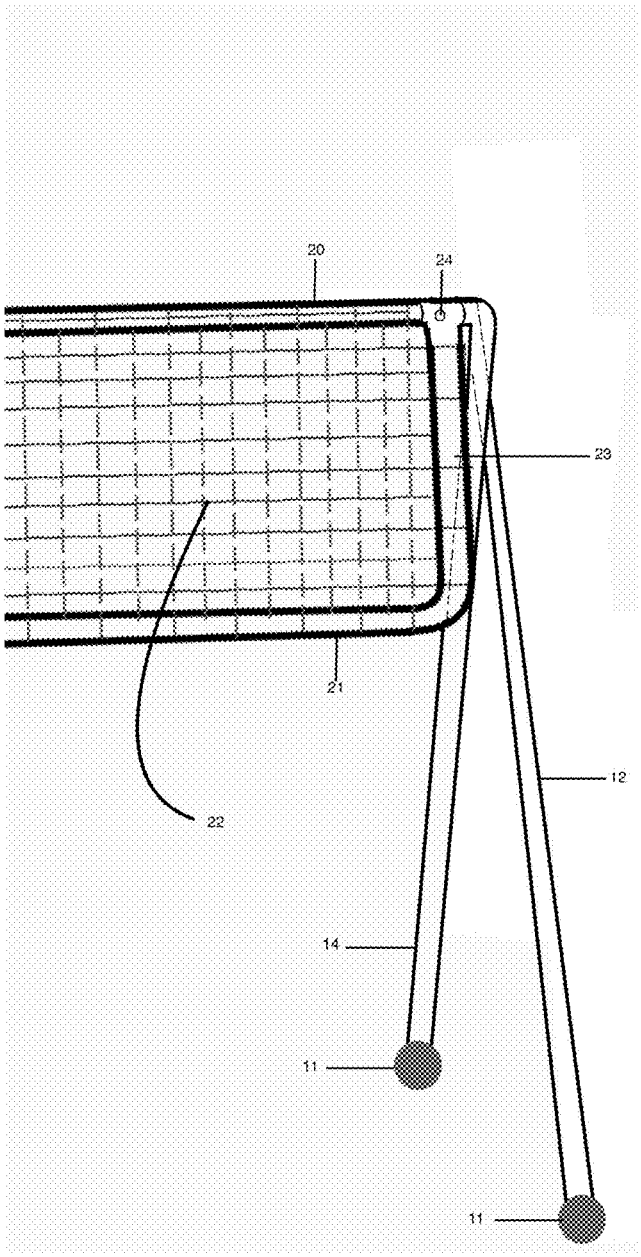
FIG. 6 shows a rear perspective view of one embodiment of the present invention.
Figure 7:
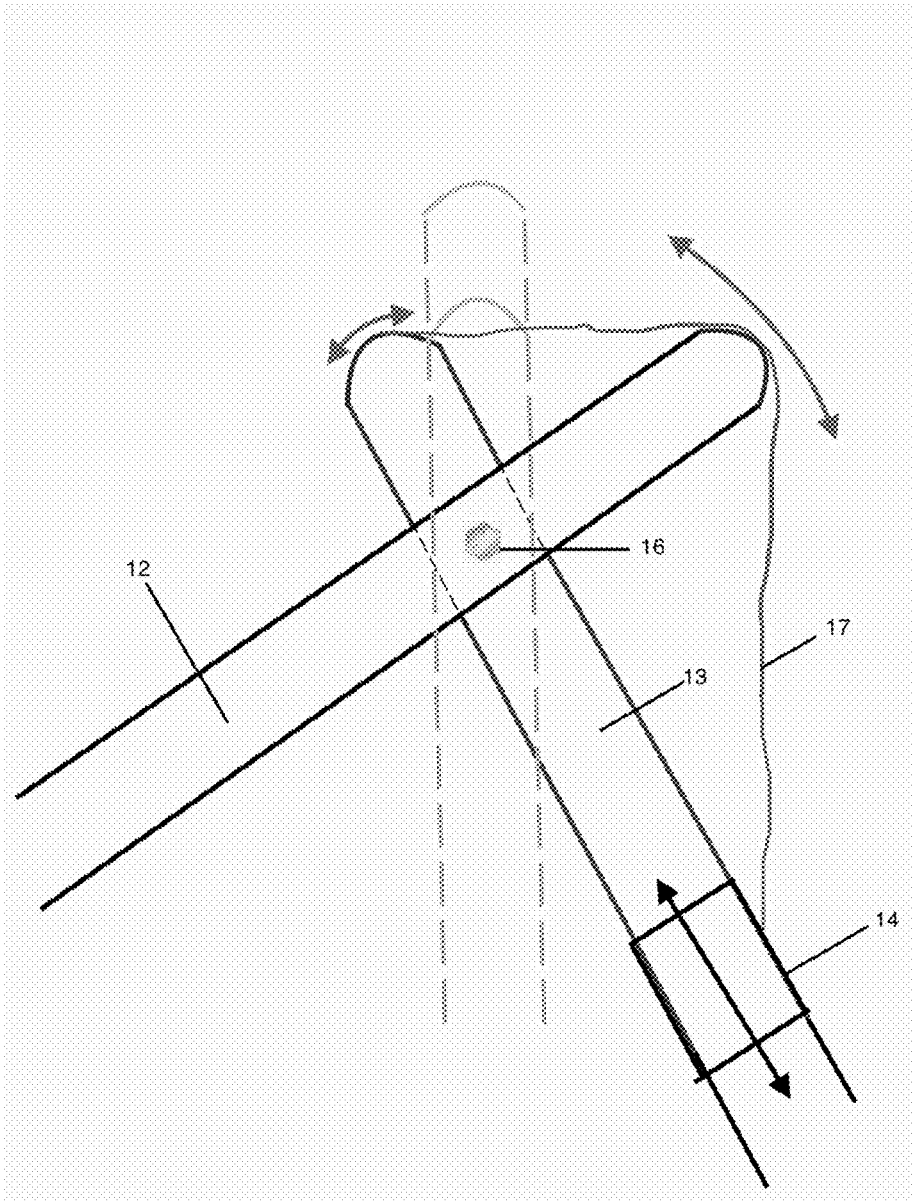
FIG. 7 shows a detail perspective view of one embodiment of the present invention.

FIG. 3 illustrates a left angle perspective, three dimensional view of the net apparatus 10. Included are rear support legs 12, front support legs 13, and horizontal cross members 18, 19, 20, and 21. Frame material can be metal, aluminum, or plastic, and should be weatherproof. Frame connections depend on the material used and preferably allow for portability. The rectangular shape formed by vertical cross members 23 and cross members 20 and 21 create a launch panel 22. As is illustrated in FIG. 6, the launch panel 22 is adjustable as it rotates around cross member 20. The use of a linchpin 24 locks the launch panel 22 into three different positions as illustrated in FIGS. 9A, 9B, 9C, and 9D. A continuous locking mechanism or push button could also be used. Removal of the linchpin 24 allows the launch panel 22 to swing freely if desired by the player. The support legs 12 and 13 are connected 16 to achieve the proper distance between cross member 19 and cross member 20 when in use. The connection 16 can utilize a bolt and wing nut or any other form of connecting such that, when loosened, the support legs 12 and 14 swivel to lower or raise the height of the net apparatus 10 as well as fold up flat for storage as shown in FIG. 7. When connection 16 is tightened the support legs 12 and 13 remain in place. Footings 11 made of non-marking rubber or recycled tennis balls assist in stabilizing the net apparatus 10 during play. The netting 17 is attached to cross members 18, 20, and 21. The netting 17 in the preferred embodiment is a regular tennis net. Spring loaded netting, elastic netting, or other material could be used instead of a tennis net 17 as long as precautions are taken so that the ball or cord do not get stuck on the net apparatus 10 during play. The netting 17 slides over the top of cross member 19. The cross members 18, 20, and 21 can be woven through the netting 17 as a means of attaching the netting 17 to the cross members 18, 20, and 21. Bungee straps 15 are utilized to connect the corners or edge of the net 17 to the apparatus 10 frame. The use of sleeves or other means of connecting the net 17 to the crossbars 18, 20, and 21 can also be utilized. A taut net 17 is optimal for best performance. Cross member 18 attaches to support legs 13 with the use of a sliding connector 14. The connector 14 slides along support legs 13, thereby allowing the player to adjust net 17 tautness. As shown in FIG. 7, the sliding connectors 14 along with the ability of the net 17 to slide over crossbar 19 allows for raising and lowering the height of the net apparatus 10, and folding flat for storage, without having to remove the net 17.

Figure 8:
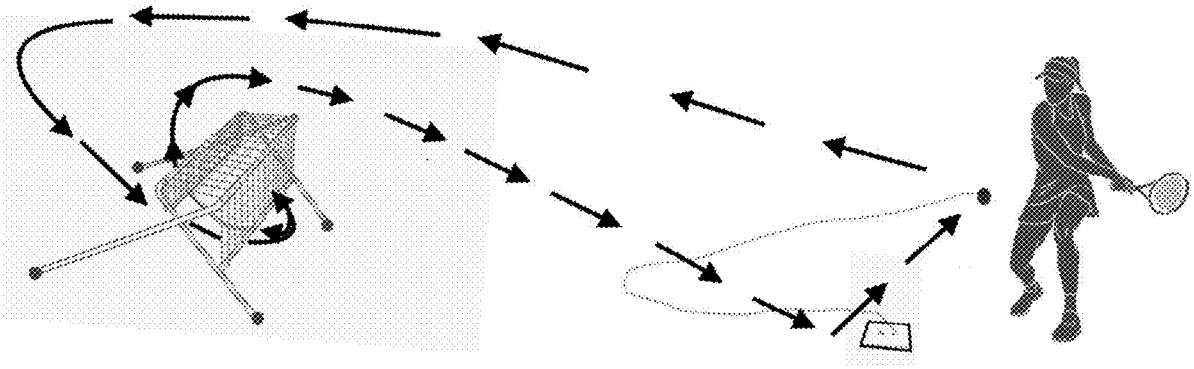
FIG. 8 shows a perspective of one embodiment of the present invention.

FIG. 8 illustrates the tethered ball 9 game comprising the rubber base 1, a tethered ball 9, a connecting elastic cord 4, 6, and 8 having adjustable means, and the net apparatus 10. The base 1 is positioned on the ground an appropriate distance from the net apparatus 10. This distance depends on the qualities of the elastic cords 4, 6, 8 and the hit power of the player. The player stands next to or behind the base 1 and hits the ball 9 over the net apparatus 10. Eventually the tension on the cord pulls the ball 9 back towards the player, and under the net apparatus 10. The net apparatus 10 receives the cord in such a manner that the ball 9 swings underneath the apparatus 10 striking the side of the net 17 closest to the player. The ball 9 then trampolines off the taut net 17, swings back under the net apparatus 10, and back to the player. During optimal performance, the ball 9 only bounces once, near the base 1, during this entire process. Once the ball 9 bounces back to the player, the player then hits the ball 9 again with his or her racket over the net apparatus 10 and the process begins again.

Figure 9A:
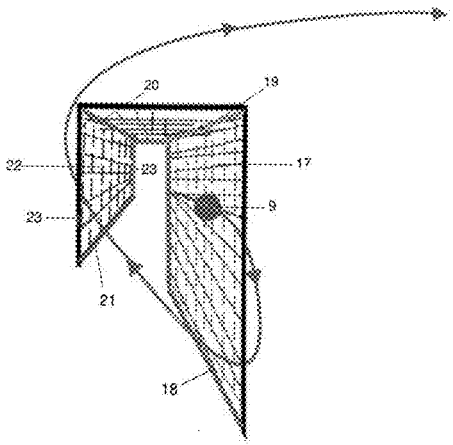
FIG. 9A shows a perspective of one embodiment of the present invention.
Figure 9B:
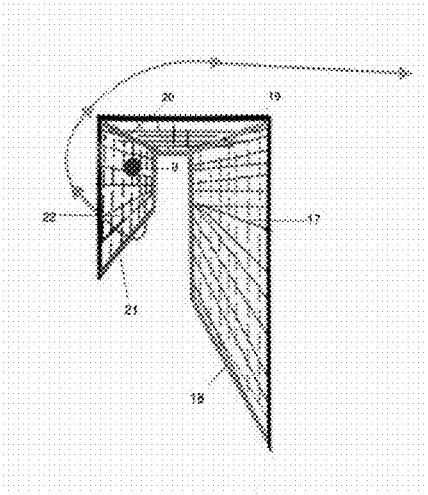
FIG. 9B shows a perspective of one embodiment of the present invention.
Figure 9C:
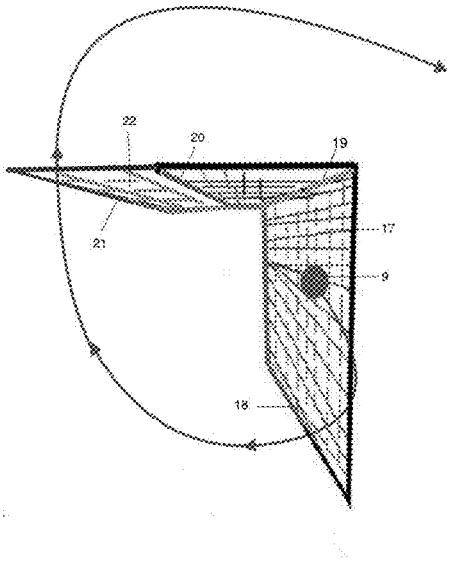
FIG. 9C shows a perspective of one embodiment of the present invention.
Figure 9D:
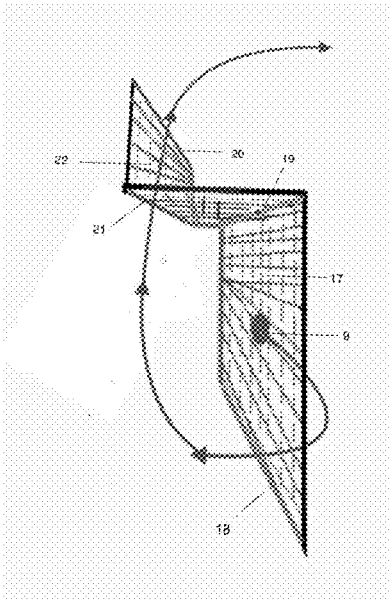
FIG. 9D shows a perspective of one embodiment of the present invention.

FIGS. 9A, 9B, 9C, and 9D show three different positions of the launch panel 22 along with four different ways in which the ball 9 returns back to the player from these positions. FIG. 9A shows the standard launch panel 22 position and associated ball 9 flight. FIG. 9B shows the launch panel 22 in the standard position, wherein the ball 9 swings behind the launch panel 22, and underneath the center of the net apparatus 10. FIG. 9C shows the launch panel 22 in a horizontal position with the resulting ball 9 flight. In this position the ball 9 will return with a higher velocity to the player than the other two positions. FIG. 9D shows the launch panel 22 in the raised vertical position. With the launch panel 22 in this position, the ball 9 returns to the player with increased height and time delay than the other positions.

As used in this application, the term "a" or "an" means "at least one" or "one or more."

As used in this application, the term "about" or "approximately" refers to a range of values within plus or minus 5% of the specified number.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A ball return assembly, configured to return a ball to a user; the ball return assembly comprising:

a base, arranged on a ground surface and further comprising a first opening and a second opening;

a cord, threaded through the first opening and the second opening;

wherein a cord lock is joined to a cord first end; preventing the cord from being pulled from the base; a ball, joined to the cord; and a frame, arranged proximate the base;

wherein the ball, upon contacting the frame, is pulled by the cord toward the base.

2. The ball return assembly of claim 1, wherein the cord comprises two or more segments connected end to end.

3. The ball return assembly of claim 1, wherein the frame further comprises a first bracket rotationally fastened to a second bracket.

4. The ball return assembly of claim 3 wherein the first bracket further comprises a first support leg joined to a second support leg with a first cross member.

5. The ball return assembly of claim 3, further comprising: a first t-joint arranged on the first support leg and configured to slide along the first support leg;

a second t-joint arranged on the second support leg and configured to slide along the second support leg;

a second cross member, joined to the first t-joint and the second t-joint.

6. The ball return assembly of claim 3, wherein the second bracket further comprises a third support leg joined to a fourth support leg with a third cross member.

7. The ball return assembly of claim 5, further comprising;

a third t-joint arranged on the first cross member and configured to rotate around a first cross member central axis;

a fourth t-joint arranged on the first cross member and configured to rotate around the first cross member central axis.

8. The ball return assembly of claim 7, further comprising:

a first lynch pin, arranged through the third t-joint and configured to prevent the third t-joint from rotating around the first cross member central axis; and a second lynch pin, arranged through the fourth t-joint and configured to prevent the fourth t-joint from rotating around the first cross member central axis.

9. The ball return assembly of claim 6, further comprising:

a net, joined to the third support leg, the fourth support leg and the first cross member, and the second cross member;

wherein the net is wrapped over the third cross member.

10. The ball return assembly of claim 2, wherein the modulus of elasticity varies for each of said two or more cord segments, and wherein the cord segment joined at the base-end has a higher modulus of elasticity than the cord segment joined at the ball-end.

* * * * *